US009480902B2

(12) United States Patent
House

(10) Patent No.: US 9,480,902 B2
(45) Date of Patent: Nov. 1, 2016

(54) FIGHTING GLOVE

(75) Inventor: Donald House, Henderson, NV (US)

(73) Assignee: ZUFFA, LLC, Las Vegas, NV (US)

( * ) Notice: Subject to any disclaimer, the term of this patent is extended or adjusted under 35 U.S.C. 154(b) by 1269 days.

(21) Appl. No.: 12/765,364

(22) Filed: Apr. 22, 2010

(65) Prior Publication Data

US 2015/0143600 A1 May 28, 2015

Related U.S. Application Data

(60) Provisional application No. 61/171,765, filed on Apr. 22, 2009, provisional application No. 61/185,145, filed on Jun. 8, 2009.

(51) Int. Cl.
*A41D 19/00* (2006.01)
*A63B 71/14* (2006.01)

(52) U.S. Cl.
CPC ..... *A63B 71/141* (2013.01); *A63B 71/145* (2013.01); *A63B 2209/10* (2013.01); *A63B 2244/10* (2013.01); *A63B 2244/102* (2013.01); *A63B 2244/106* (2013.01)

(58) Field of Classification Search
CPC ..... A41D 13/084; A41D 19/015; A41D 19/0017; A63B 71/14
USPC ..... 2/161.1, 161.2, 161.5, 161.6, 163, 162
See application file for complete search history.

(56) References Cited

U.S. PATENT DOCUMENTS

| | | | | |
|---|---|---|---|---|
| 4,183,100 | A * | 1/1980 | De Marco | 2/159 |
| 4,400,829 | A * | 8/1983 | Willis | A63B 71/148 2/16 |
| 4,701,963 | A | 10/1987 | Overton | |
| 4,843,651 | A | 7/1989 | Gramza et al. | |
| 5,079,776 | A * | 1/1992 | Crawford | 2/20 |
| 5,295,269 | A * | 3/1994 | Ballard | 2/18 |
| 5,538,501 | A * | 7/1996 | Caswell | 602/64 |
| 5,557,806 | A | 9/1996 | Caswell et al. | |
| 5,566,389 | A * | 10/1996 | Li | 2/16 |
| 5,600,849 | A * | 2/1997 | Hu | 2/16 |
| 5,706,521 | A | 1/1998 | Haney | |
| 5,740,555 | A * | 4/1998 | Renegar | 2/161.2 |
| 6,013,044 | A * | 1/2000 | Estwanik | 602/64 |
| 6,553,574 | B1 | 4/2003 | Hall, Jr. et al. | |
| 6,691,315 | B1 | 2/2004 | Clarke et al. | |
| 6,704,936 | B1 * | 3/2004 | Carlin | 2/18 |
| 2003/0217404 | A1 * | 11/2003 | Hurst | 2/161.6 |
| 2008/0078010 | A1 * | 4/2008 | Micheloni | 2/160 |
| 2009/0089909 | A1 * | 4/2009 | Castro | 2/16 |
| 2012/0017349 | A1 * | 1/2012 | McCrane | 2/161.1 |

* cited by examiner

*Primary Examiner* — Sally Haden
(74) *Attorney, Agent, or Firm* — Dickinson Wright PLLC

(57) ABSTRACT

A glove useful for mixed martial arts fighting has padded knuckles for the four non-opposed fingers, with the lower half of each of the fingers not enclosed. The palm of the glove is open, and the thumb is not covered. The glove has an inner pair of attachment straps closable across each other over the wrist, and installed over the attachment straps is a closable outer support or stability strap that wraps around the wrist. Both the attachment straps and the support strap are preferably closable through use of a hook and loop fastening means such as Velcro®.

5 Claims, 13 Drawing Sheets

FIGHTING GLOVE

CROSS-REFERENCE TO RELATED APPLICATIONS

This application claims priority to U.S. Provisional Patent Application Ser. No. 61/171,765 filed Apr. 22, 2009 and Ser. No. 61/185,145 filed Jun. 8, 2009, the entirety of which are incorporated by reference herein.

BACKGROUND OF THE INVENTION

1. Field of the Invention

The present invention relates to gloves and, more specifically, to gloves for utilization in mixed martial arts fighting.

2. The Prior Art

Gloves used in hand-to-hand combat have been known for millennia. For example, during Roman times, gladiators wrapped their hands to box. More recently, boxing gloves have evolved to what is well known today. They are almost totally aimed at punching, and possibly deflecting punches. Karate gloves are typically fairly similar to boxing gloves, again being designed primarily for punching, though in the case of Karate, the punching may be done with more than just a clinched fist. Some Karate gloves allow for some use of the hands for grasping. However, as with boxing gloves, Karate gloves typically have a single compartment for all four of the non-opposed fingers on each hand, with another compartment for the thumb.

Mixed martial arts ("MMA") is a reasonably recent phenomenon. Initially, it allowed for any type of unarmed combat between two participants. The primary organization behind its growth has been the UFC® (Ultimate Fighting Championship®. The precursor to MMA was initially so controversial that it was either banned or dropped from TV. In order to overcome this problem, rules have slowly been introduced to define the activity into a legalized and regulated sport. Still, the combatants in such a fighting sport have a requirement to be able to both hit and grasp or grapple. Traditional boxing and Karate gloves do not provide this capability.

BRIEF SUMMARY OF THE INVENTION

A fighting glove 10 useful for mixed martial arts fighting has padding for covering a back of a hand and knuckles of a fighter. The palm of the glove is open, and the thumb is not covered. (FIG. 4 and FIG. 13) The glove has attachment straps closable across each other over the wrist 19 (FIG. 4) and installed over the attachment straps is a closable support or stability strap that wraps around the wrist. Both the attachment straps and the support strap are preferably closable through use of hook and loop fastening means such as Velcro®.

DETAILED DESCRIPTION

Figure 1:
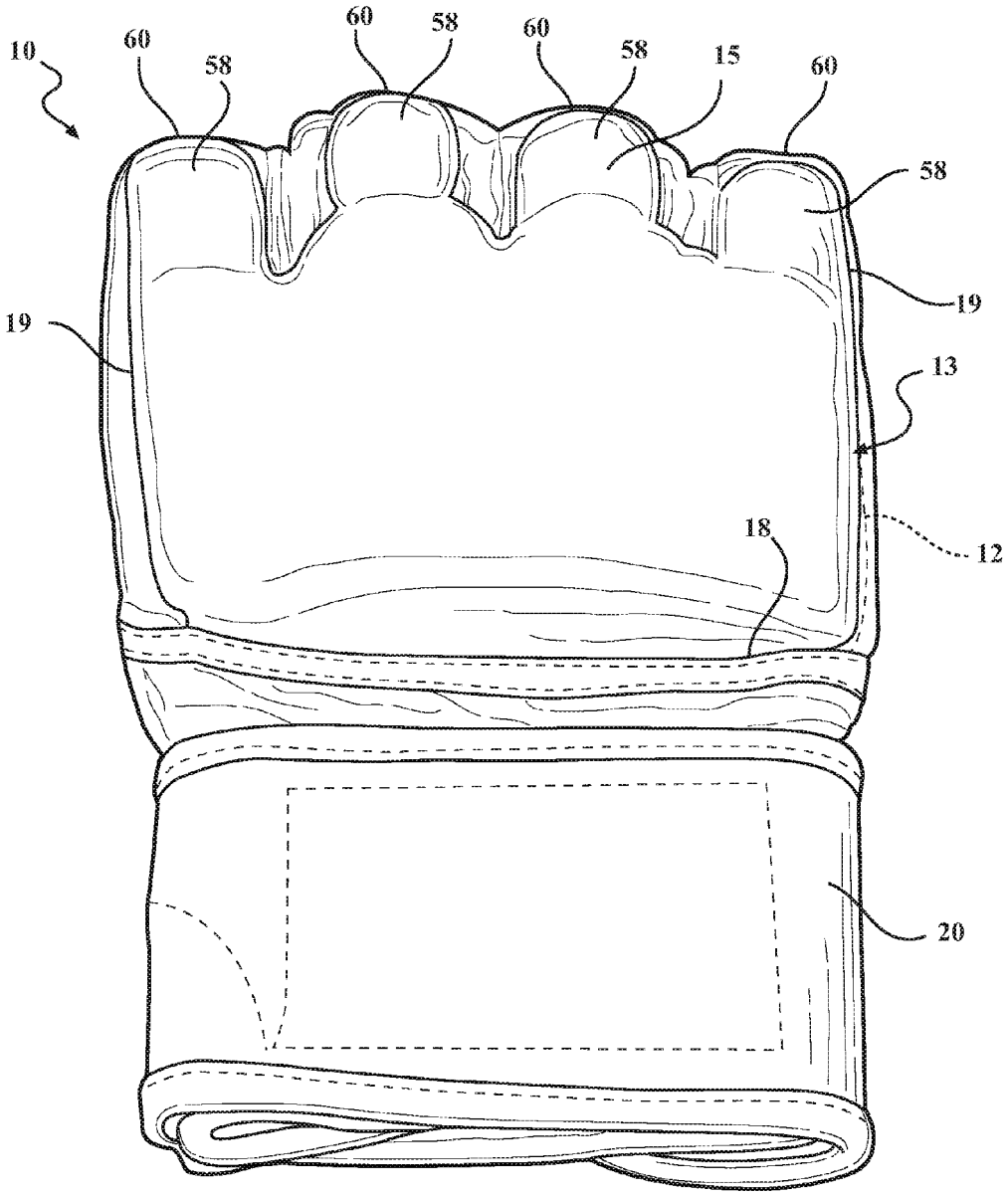
FIG. 1 is a top view of an improved fighting glove, in accordance with one embodiment of the present invention.

FIG. 1 is a top view of an improved fighting glove 10 for a fighter where the fighter has a wrist 42 and a hand 40 including a palm 44, a thumb 46, and a plurality of fingers 48 (FIG. 7), in accordance with one embodiment of the present invention. The fighting glove 10 comprises of a back hand cover 13 for covering a back of a hand of the fighter. The back hand cover 13 includes a top 15 and a bottom 18 spaced apart from one another by a pair of sides 19 with the pair of sides extending between the top 15 and the bottom 18. In a preferred embodiment, finger sleeves 58 of the glove 10 are padded 12. Currently, Ultimate Fighting Championship® bouts require at least one inch of padding 12 over the knuckles of the fighter, which results in approximately 4 to 6 ounces of padding per glove. The finger sleeves 58 are disposed next to one another along an upper portion 22 of a front hand cover 21 and a top 15 of a back hand cover 13 for surrounding the fingers of the fighter and each finger sleeves 58 extends outwardly from the covers 21, 13 to a distal end 60. In a preferred embodiment, the finger sleeves 58 in the gloves may end at approximately the second joint on each finger of the fighter to cover the knuckles of the fighter. The padding 12 of the fighting glove 10 is disposed in the interior 16 and attached to the back hand cover 13 and the finger sleeves 58 and extends from the distal end 60 of the finger sleeves 58 to the bottom 18 of the backhand cover 13 for covering the back of the hand and the knuckles of the fighter 40. A stability or support strap 20 wraps at least substantially around the wrist 42 of the fighter to secure the glove 10 to the fighter. Currently, official Ultimate Fighting Championship® gloves have UFC® logos on both the finger sleeves 58 and top of the support strap 20. The fighting glove 10 is preferably constructed from soft leather to provide both comfort and durability, but may be constructed of other materials. In the preferred embodiment, both the support straps and the attachment straps are similarly constructed from leather, the attachment straps of similar leather to the rest of the glove, and the stability or support strap of possibly a heavier leather. Also, the seams are preferably double stitched, and the edges of the glove rolled over before being seamed, for durability.

Figure 2:
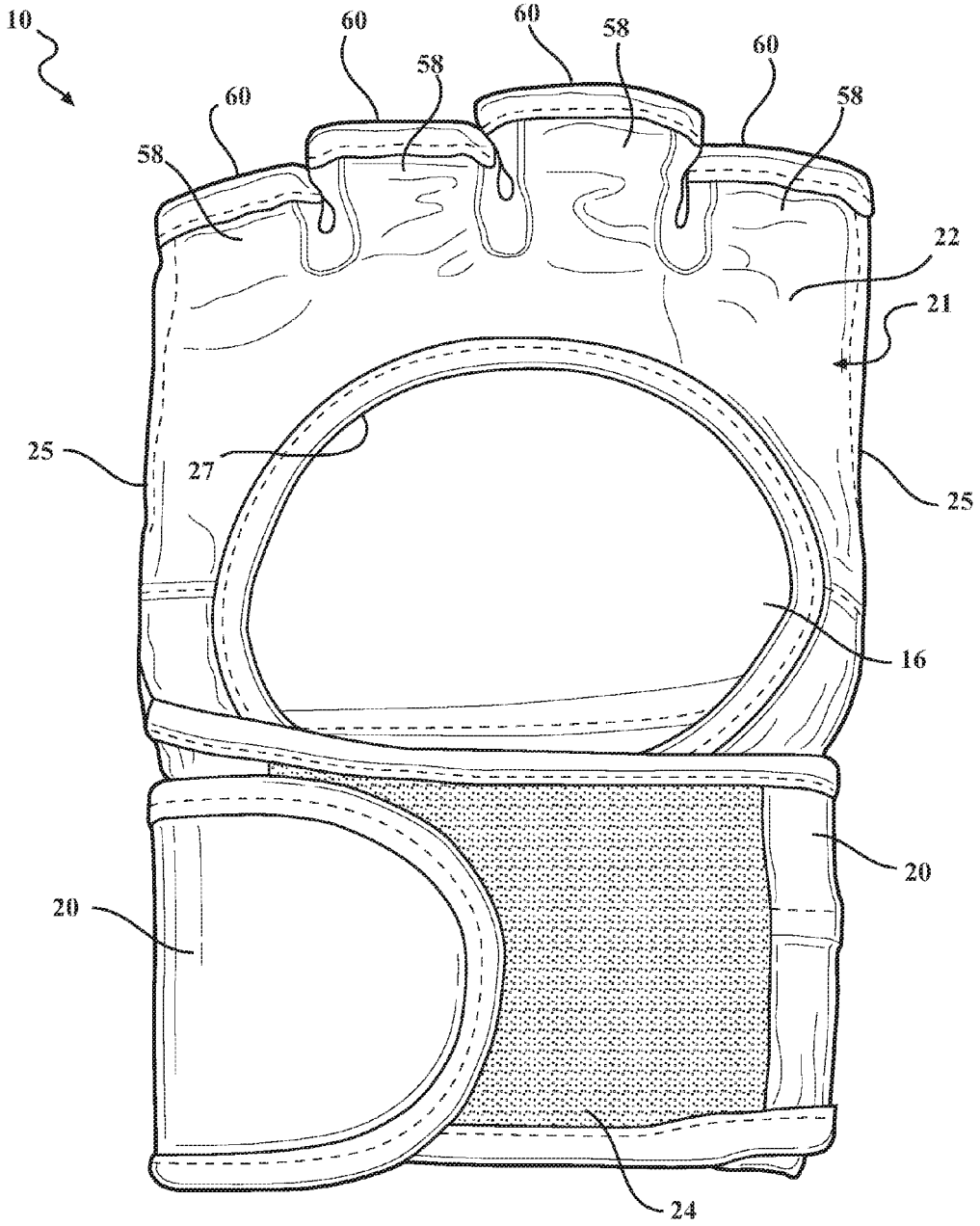
FIG. 2 is a bottom view of the improved fighting glove 10 shown in FIG. 1.

FIG. 2 is a bottom view of the fighting glove 10 shown in FIG. 1. The fighting glove 10 comprises of a front hand cover 21. The front hand cover 21 includes an upper portion 22 and a lower portion 23 spaced apart from one another by a pair of edges 25 between the upper portion 22 and the lower portion 23. Each of the pair of edges 25 connect to each of the pair of sides 19 to define an interior 16 between the front hand cover 21 and the back hand cover 13 for receiving the hand 40 of the fighter. The front hand cover 21 further includes an aperture 27 between and spaced from the pair of edges 25 and extending toward and spaced from the upper portion 22 for exposing the palm 44 and the thumb 46 of the fighter when the hand 40 of the fighter is disposed in, i.e., the fighting glove 10 is being worn by the fighter or is in an installed condition, the interior 16 of the fighting glove 10. The interior 16 of the fighting glove 10 may include an absorbent lining that wicks away perspiration when a fighter wearing the fighting glove 10 is fighting or training. In the preferred embodiment, the absorbent lining is a lining of absorbent material that is disposed in the interior 16. The lining of absorbent material covers the padding 12 and is attached to the back hand cover 13 and the front hand cover 21 and extends from the bottom 19 of the back hand cover 13 and the lower portion 23 of the front hand cover 21 to the distal ends 60 of the fingers sleeves 58 for wicking away perspiration from the hand 40 of the fighter. Also visible is a stability or support strap 20 and a second plurality of fasteners 24.

Figure 3:
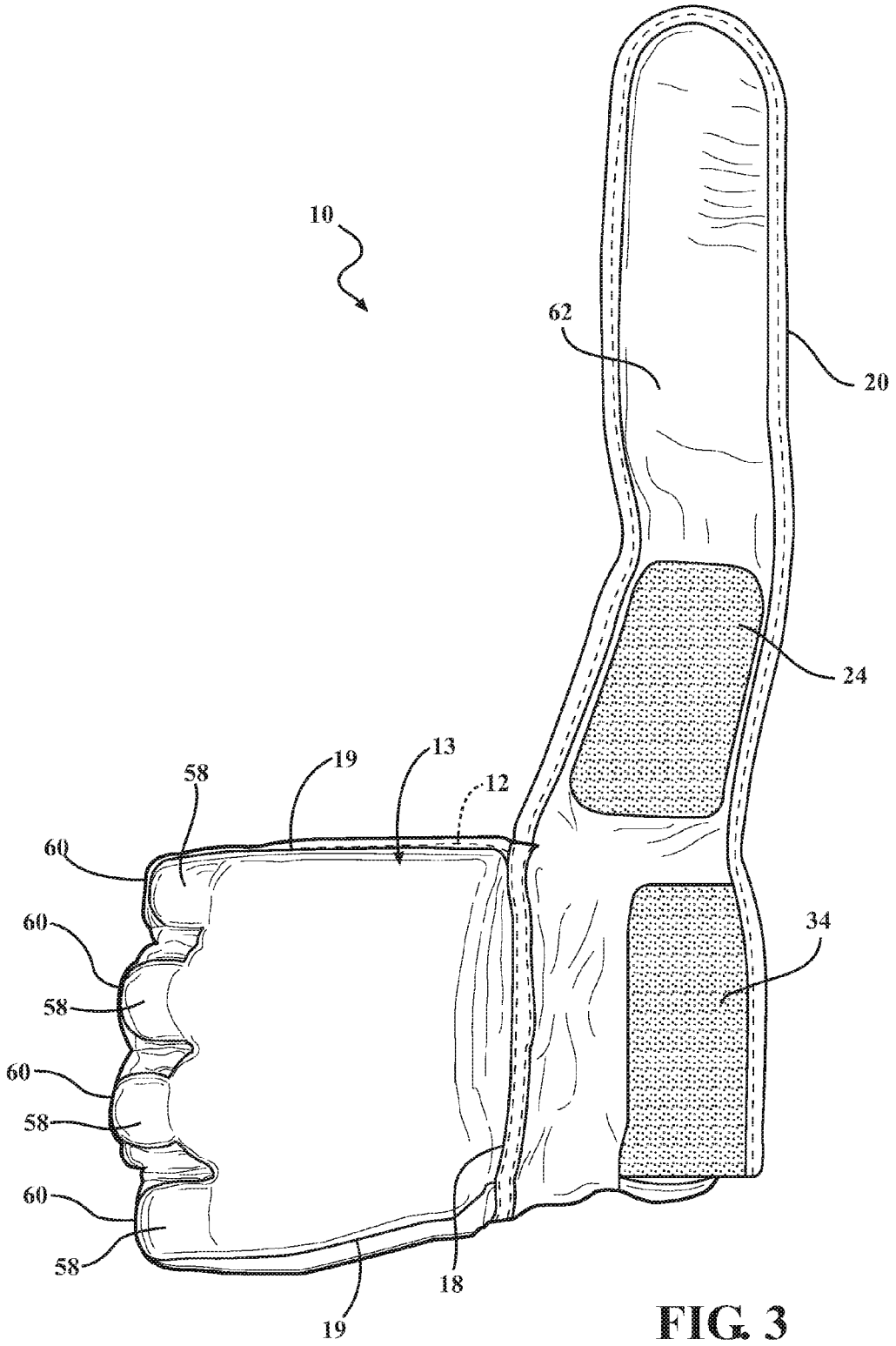
FIG. 3 is a top view of the improved fighting glove shown in FIG. 1.

FIG. 3 is a top view of the fighting glove 10 with the support strap 20 unattached and unwrapped. The support strap 20 extends outwardly from the back hand cover 13 and adjacent to one of the pair of edges 25 for wrapping around the lower portion 23 of the front hand cover 21 and the back hand cover 13.

Figure 4:
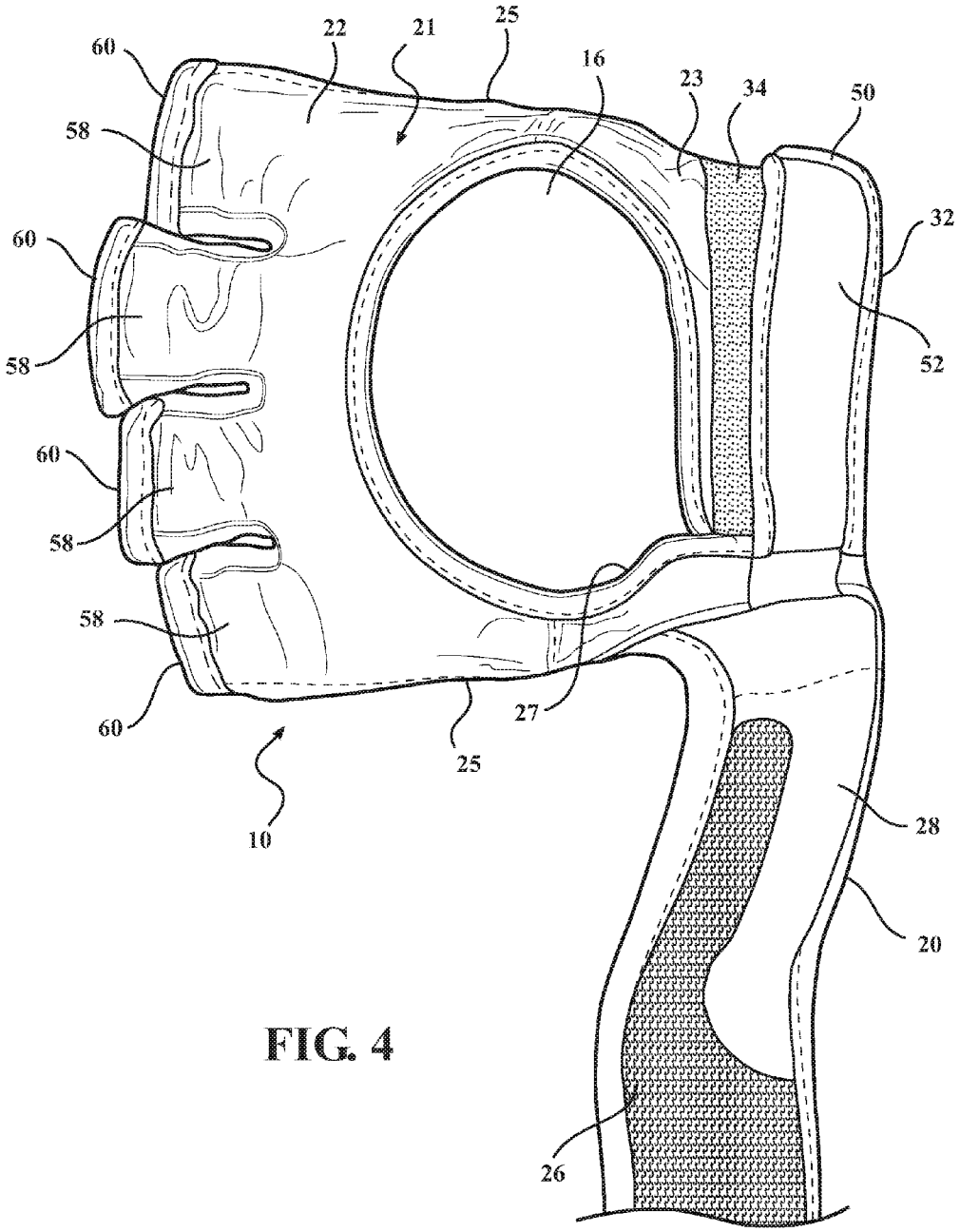
FIG. 4 is a bottom view of the improved fighting glove shown in FIG. 2.

FIG. 4 is a bottom view of the fighting glove 10 with its support strap 20 unattached and unwrapped. The lower portion 23 of the front hand cover 21 and the bottom 18 of the back hand cover 13 define an inner attachment strap 30 having a first plurality of fasteners 34 (see FIG. 3 and FIG. 5). The outer attachment strap 32 extends from one of the pair of edges 25 of the front hand cover 21 to a coupling end 50 and defines an outer surface 52 extending from the one of the pair of edges 25 to the coupling end 52 for covering at least a portion of the inner attachment strap 30 adjacent to the lower portion 23 of the front hand cover 21. The outer attachment strap 32 also includes an inner surface, shown by element number 36, having a third plurality of fasteners 36 extending between the one of said pair of edges 25 of the front hand cover 21 and the coupling end 52 for locking the third plurality of fasteners 36 with the first plurality of fasteners 34 on the inner attachment strap 30 when the hand of the fighter is disposed in the interior 16 of the fighting glove 10 in the installed condition. The inner surface of the outer attachment strap 32 has a first surface area of the third plurality of fasteners 36 and the inner attachment strap has a second surface area of the first plurality of fasteners 34 at least twice as large as the first surface area and the third plurality of fasteners 36 extend between one of the pair of edges 25 of the front hand cover 21 and the coupling end 50 for engaging a portion of the first plurality of fasteners 34 of the inner attachment strap 30 adjacent to the lower portion 23 of the front hand cover 21.

Referring back to FIGS. 1 and 3, the support strap 20 has an inside surface 26, 28 having a fourth plurality of fasteners 26 for attaching the end of the support strap 20 to either the fighting glove 20 or, more typically, itself for covering the attachment straps 30, 32 in the installed condition. The support strap 20 extends outwardly from the back hand cover 13 and adjacent to one of the pair of edges 25 of the front hand cover 21 for wrapping around the lower portion 23 of the front hand cover 21 and the bottom 18 of the back hand cover 13 and in overlapping relationship with the attachment straps 30, 32 to wrap around the wrist 42 of the fighter and to secure the front hand cover 21 and said back hand cover 13 to the wrist 42 of the fighter in the installed condition. In the preferred embodiment, and as shown in the FIGS., the support strap 20 wraps entirely around the wrist 42 of a fighter. The support strap 20 also defines an exterior surface 62 opposite and parallel to the inside surface 26, 28 and presenting the second plurality of fasteners 24 adjacent one of the pair of edge 25 of the front hand cover 21 for receiving the fourth plurality of fasteners 26 of the inside surface 26, 28 of the support strap 20 as the support strap 20 is wrapped around the wrist of the fighter and in overlapping relationship with the second plurality of fasteners 24 in the installed condition. It is to be appreciated that the first plurality of fasteners 34, the second plurality of fasteners 24, the third plurality of fasteners 36, and the fourth plurality of fasteners 26 can be of hook fasteners or loop fasteners of a Velcro® material.

Figure 5:
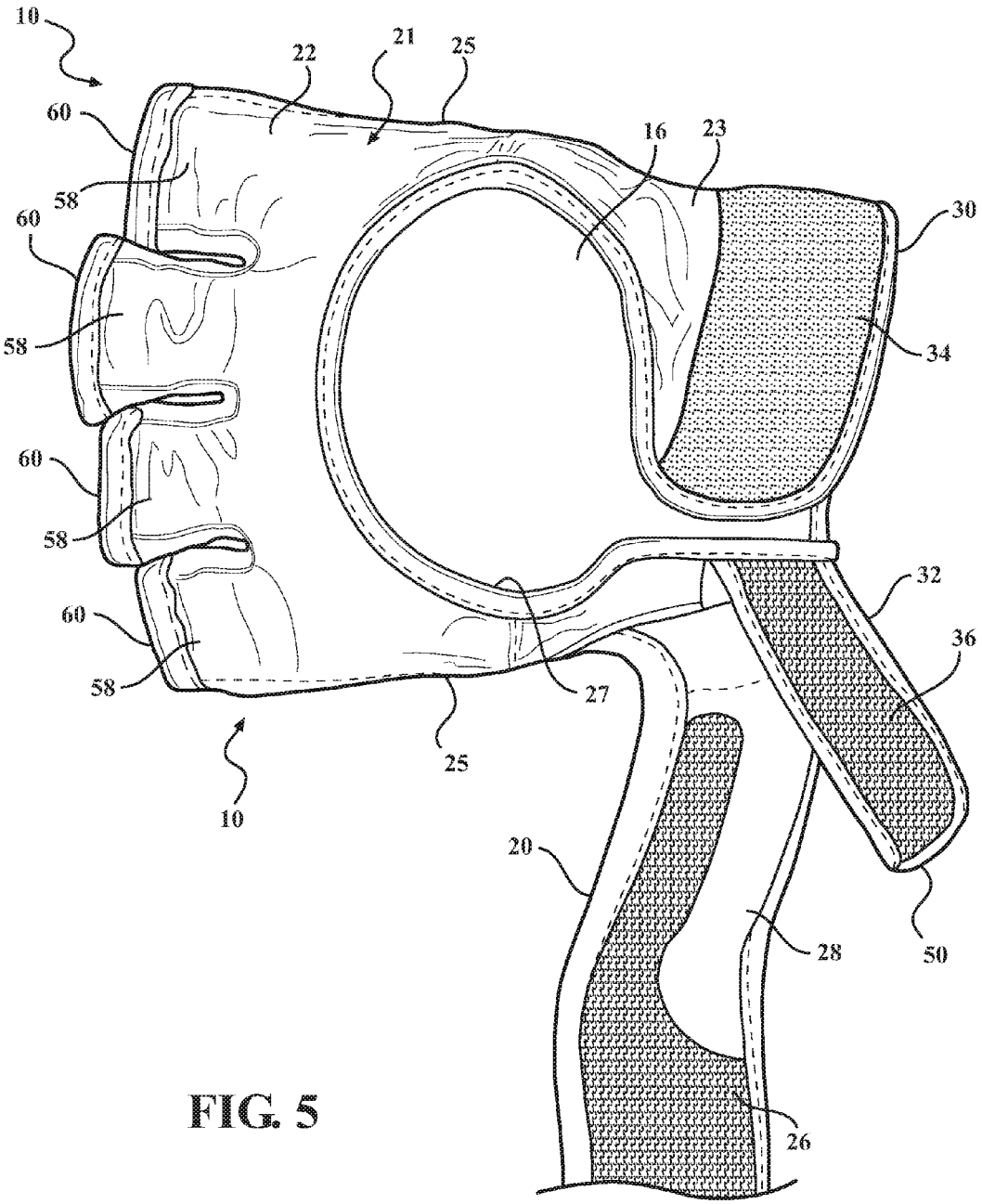
FIGS. 5 and 6 are bottom views of the improved fighting glove shown in FIG. 4.
Figure 6:
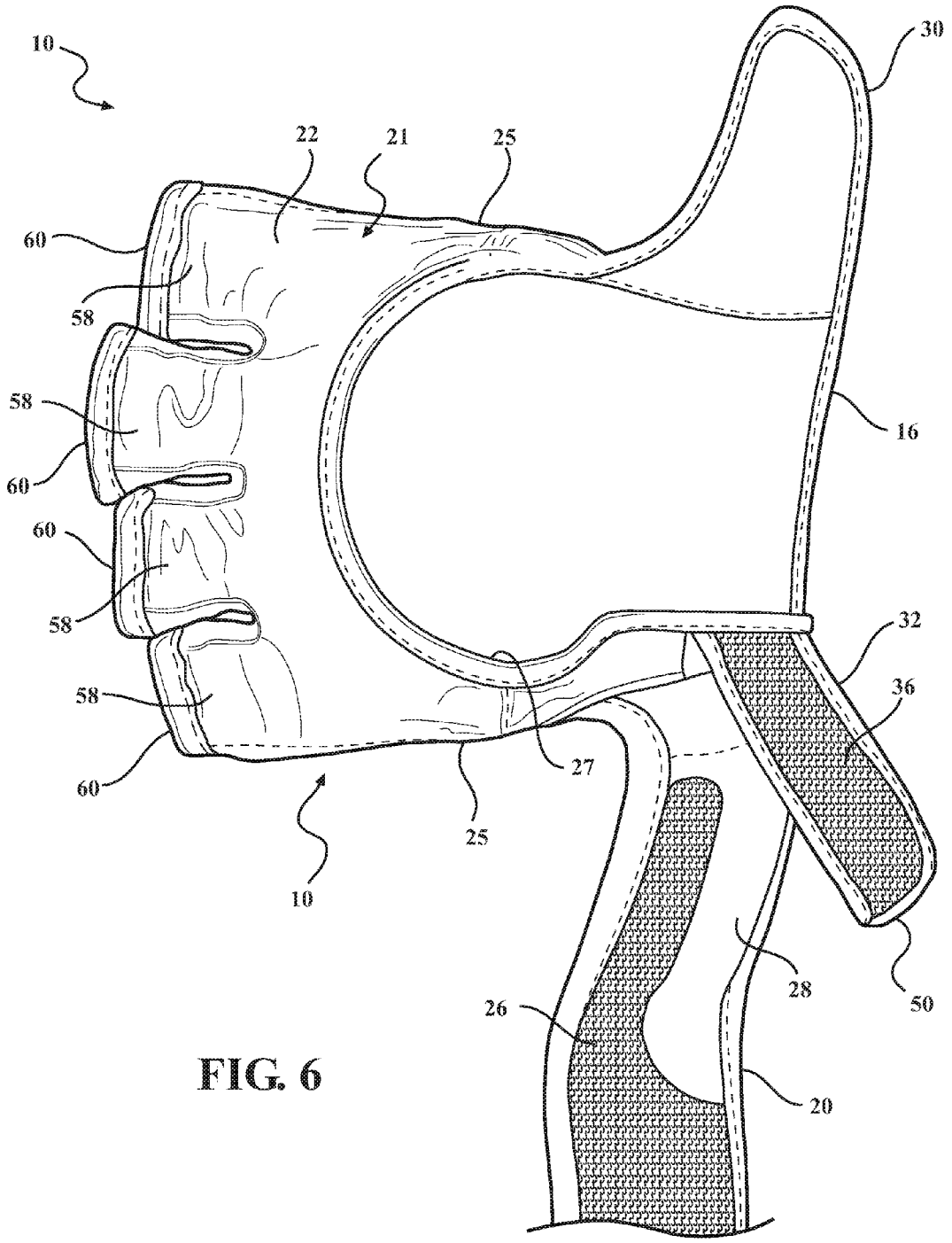

FIGS. 5 and 6 are bottom views of the fighting glove 10 shown in FIG. 4 with the support or stability strap 20, the inner attachment strap 30 and the outer attachment strap 32 unattached. FIG. 5 shows the inner attachment strap 30 folded in, and the outer attachment strap 32 folded out, over the unwrapped support strap 20. FIG. 6 shows the inner attachment strap 30, and the outer attachment strap 32 folded out, ready for being put on the hand of a fighter. The first plurality of fasteners 36 and the fourth plurality of fasteners 26 are shown as hook fasteners and the second plurality of fasteners 24 and the third plurality of fasteners 36 are shown as loop fasteners. The support strap 20 is wrapped around the wrist 42 of the fighter, and the hook and loop fasteners 26, 32, 34 are engaged to keep it tight. Also shown is the inside surface 26, 28 of the support strap 20 and the fourth plurality of fasteners 26. Note that in a preferred embodiment, the fourth plurality of fasteners 26 on the inside surface 26, 28 of the support strap 20 are missing over the top of the outer attachment strap 32 for better operation. More specifically, the inside surface 26, 28 of the support strap 20 presents a smooth portion 28 extending from the back hand cover 13 in a parallel relationship and coextensive with the fourth plurality of fasteners 26 adjacent the outer attachment strap 32 and the smooth portion 28 defines a surface area equal to the outer surface 52 of the outer attachment strap 32 for covering and freedom from attachment to the outer surface 52 of the outer attachment strap 32 in the installed condition. In the preferred embodiment, the leather from the rest of the glove extends through the attachment straps 30, 32 as shown for the interior 16 of the inner support strap 30 in FIG. 6. Also, in one embodiment, wicking material may also cover both the inside of the glove and the inside of the inner attachment strap 30. While two overlapping straps are shown in this preferred embodiment, it should be understood that utilizing a single strap attaching to the glove with a removable attachment means such as hook and loop fasteners is also within the scope of the present invention. Also, other means for removably providing the attachment than the use of hook and loop fasteners are also within the scope of the present invention.

Figure 7:
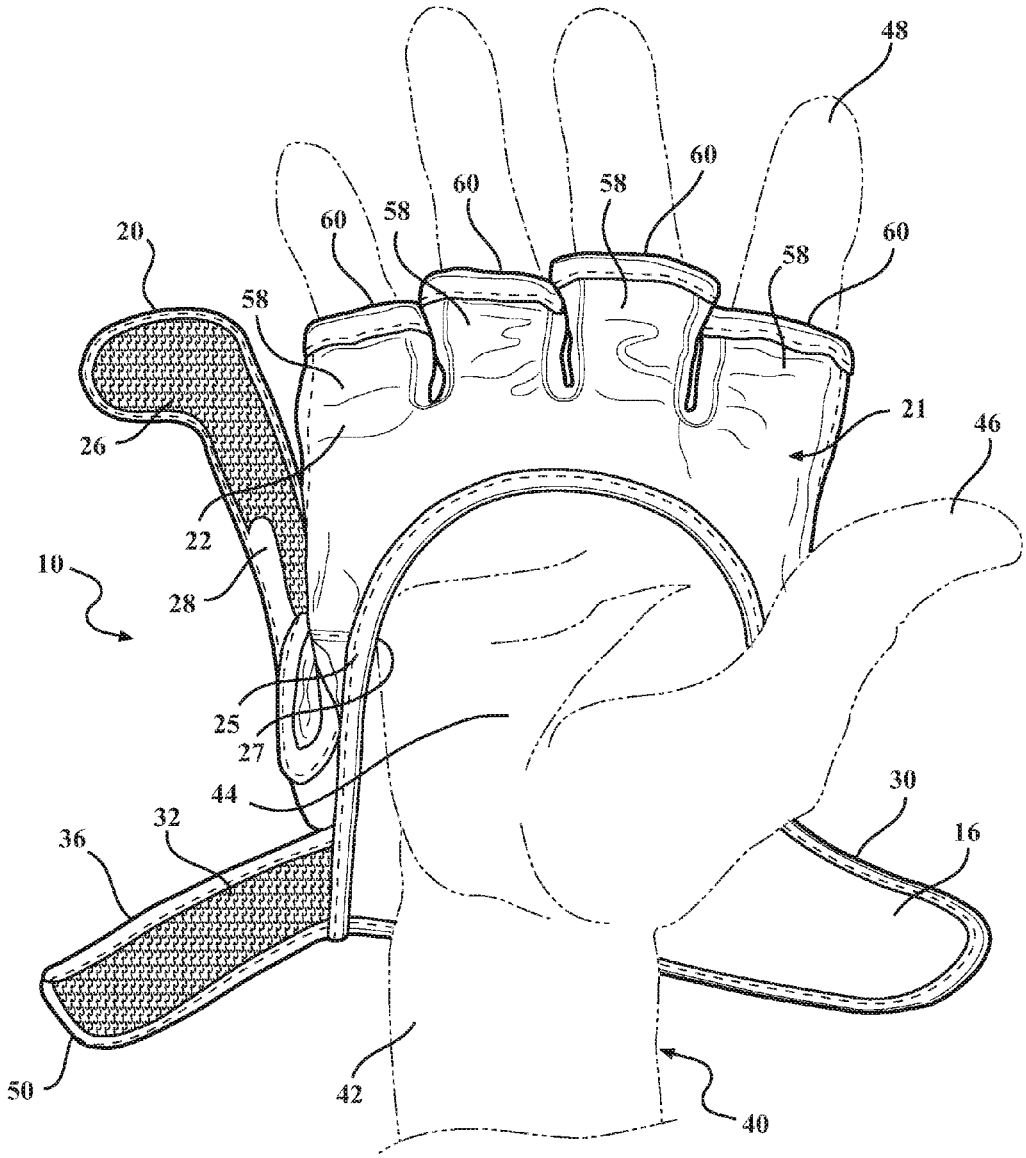
FIGS. 7 and 8 are bottom views of the improved fighting glove shown in FIG. 6.
Figure 8:
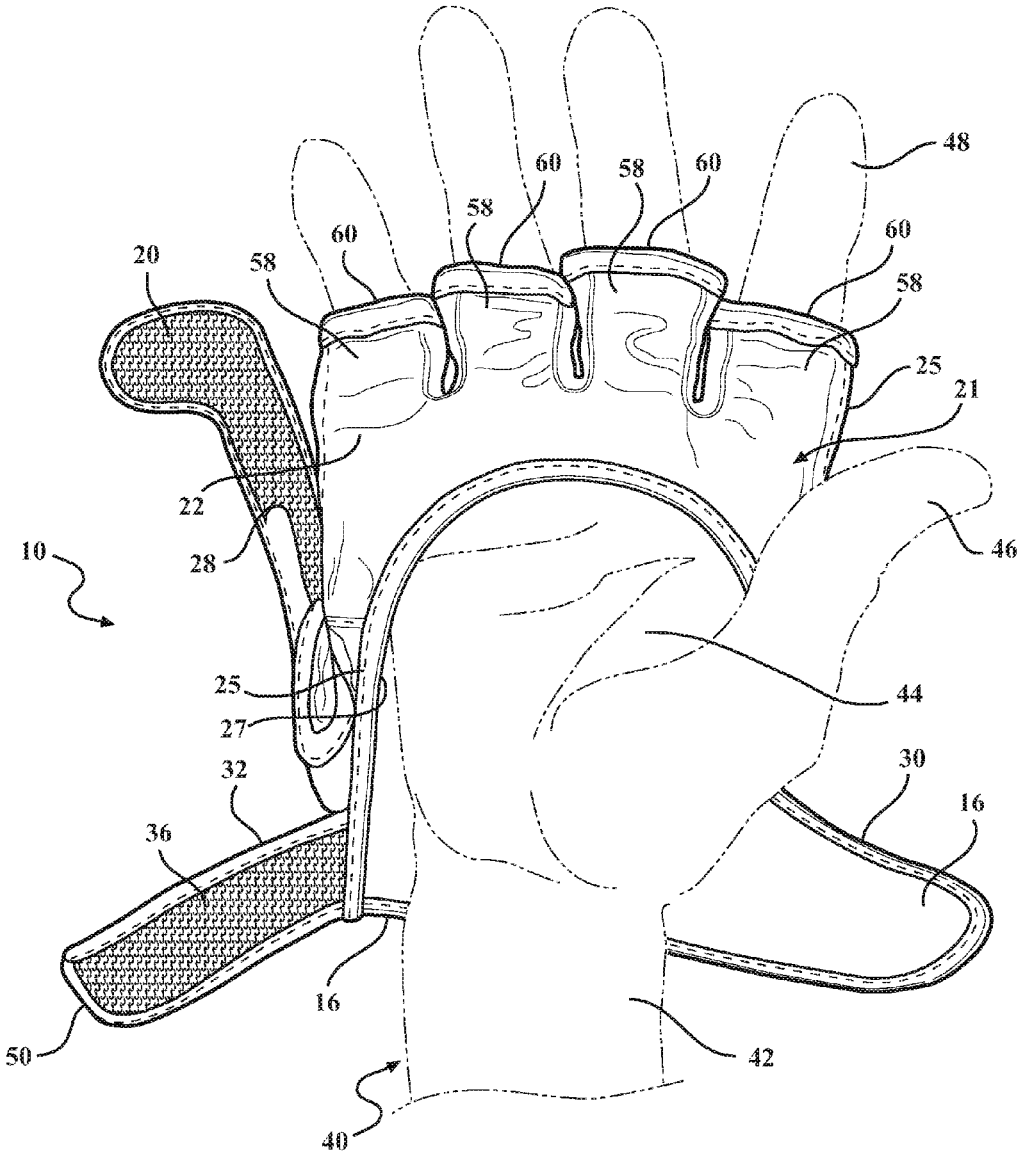

FIGS. 7 and 8 are bottom views of the fighting glove 10 shown in FIG. 6 with the support or stability strap 20 and the attachment straps 30, 32 being folded back, as it is being put on by a fighter. The attachment straps 30, 32 consist of an inner attachment strap 30 and an outer attachment strap 32 that attaches over the top of the inner attachment strap 30 using the hook 36 and loop 34 fasteners to close the attachment straps 30, 32 together. The glove is shown being put on the hand of a fighter 40. The fighter's wrist 42, palm 44, thumb 46, and fingers 48 are shown. When completely installed on a fighter 40, this embodiment of the glove 10 has an open palm 44 and thumb 46 area and the fingers 48 of the fighter extend through the finger sleeves 58 and the finger holes 14.

Figure 9:
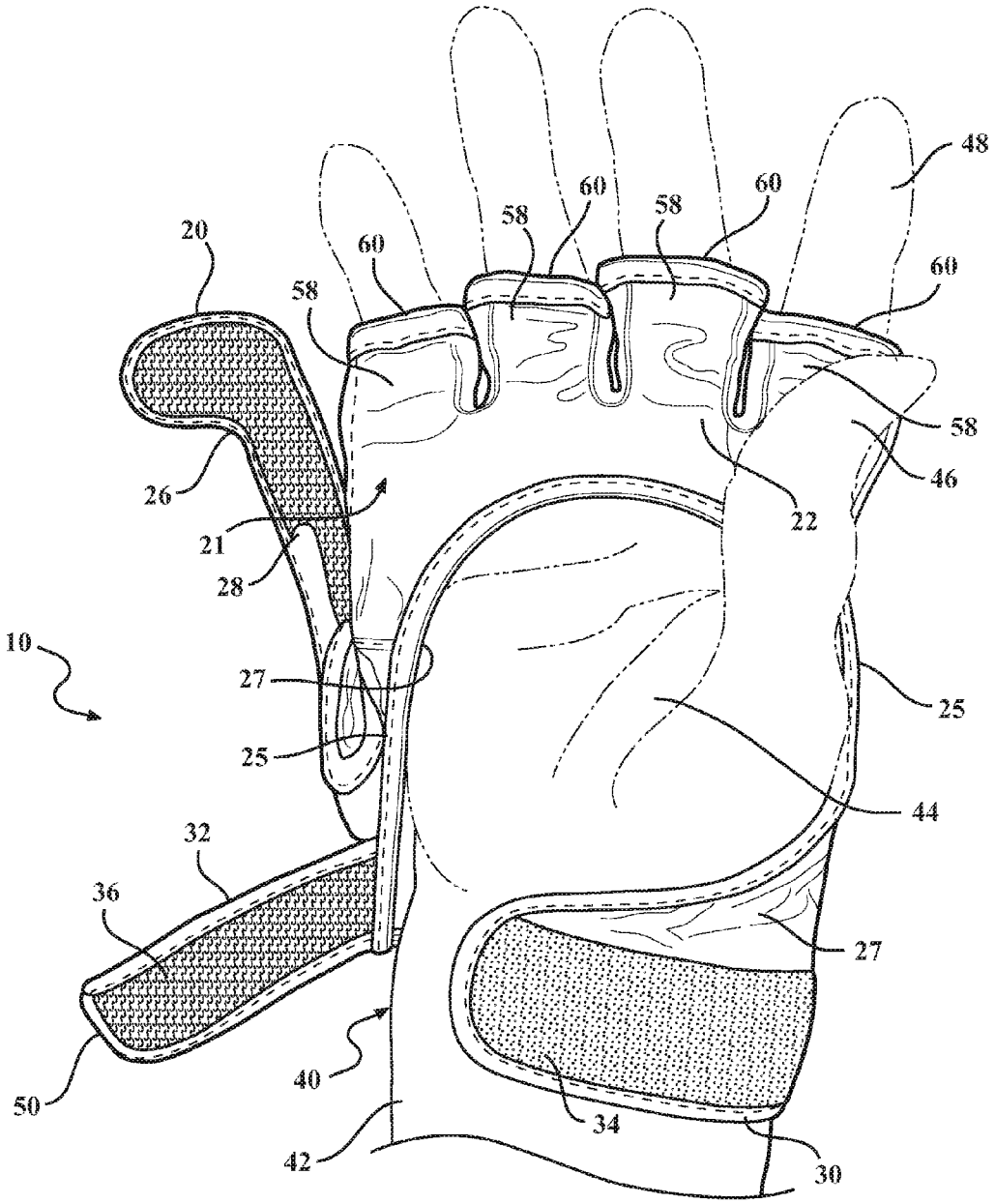
FIGS. 9 and 10 are bottom views of the improved fighting glove shown in FIGS. 7 and 8.
Figure 10:
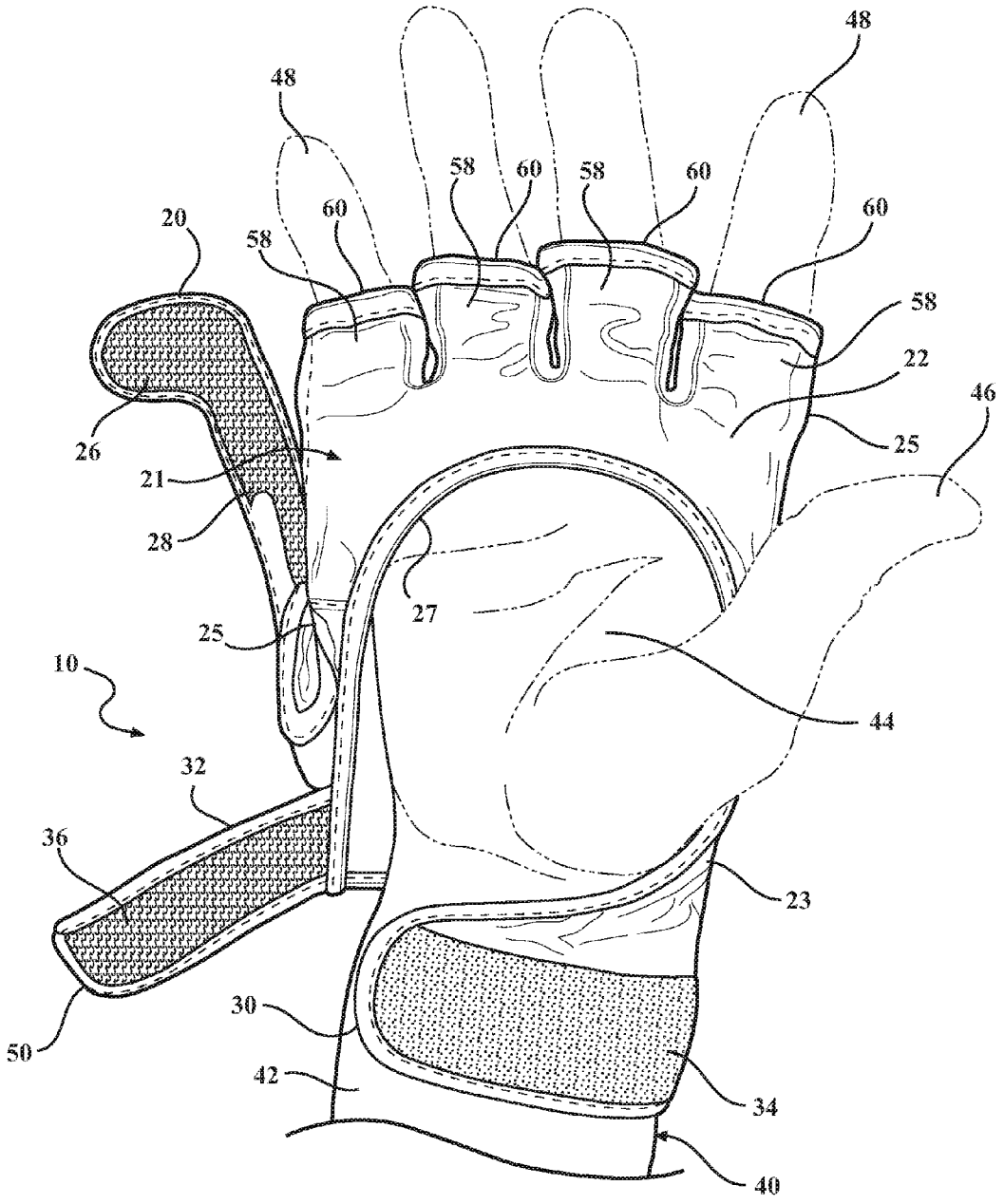

FIGS. 9 and 10 are bottom views of the improved fighting glove 10 shown in FIGS. 7 and 8 with the inner attachment strap 30 folded over the wrist 42 of the fighter 40, and the outer attachment strap 32 folded back from the opposite direction. Also folded back, behind the outer attachment strap 32, is the stability or support strap 20. These FIGS.

show the inner attachment strap 30 being held down preparatory to the outer attachment strap 32 being closed over it in the installed condition.

Figure 11:
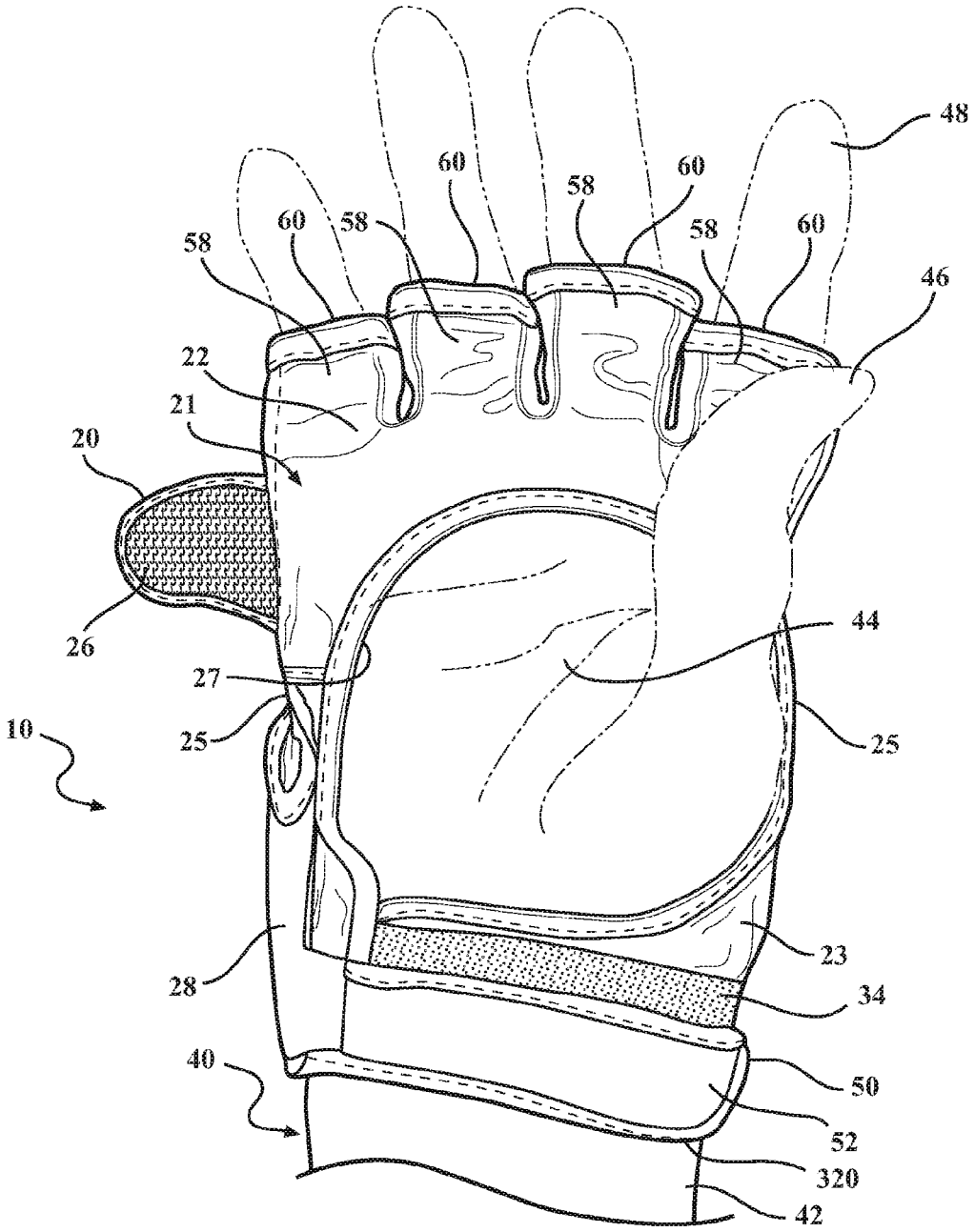
FIGS. 11 and 12 are bottom views of the improved fighting glove shown in FIGS. 9 and 10.
Figure 12:
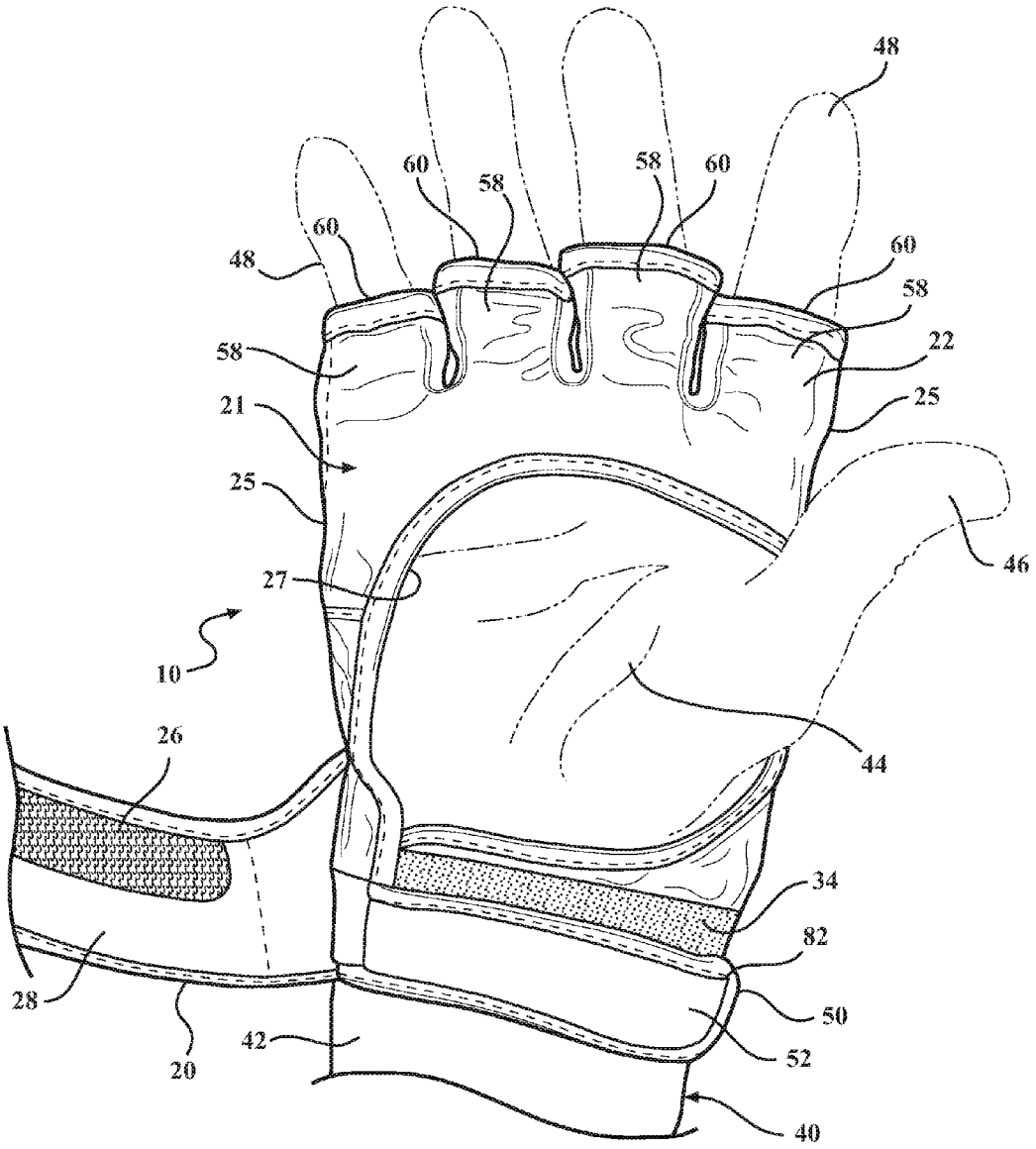

FIGS. 11 and 12 are bottom views of the fighting glove 10 shown in FIGS. 9 and 10 with the attachment straps 30, 32 being closed over each other, but before the stability or support strap 20 has been closed. FIG. 11 shows the outer stability or support strap 20 folded back, and FIG. 12 shows it being held in preparation for being wrapped around the wrist 42 of a fighter and closed in the installed condition.

Figure 13:
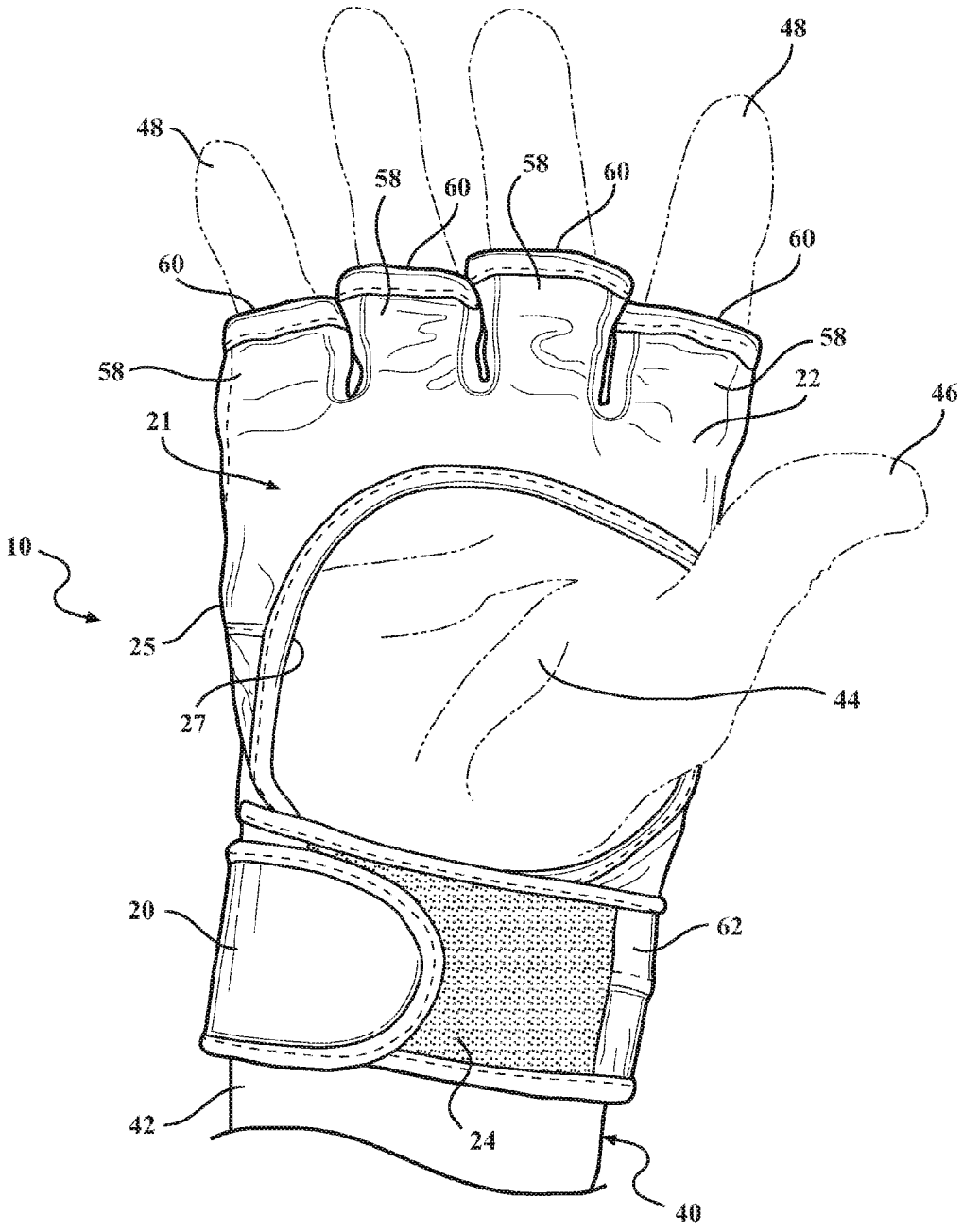
FIG. 13 is a bottom view of the improved fighting glove shown in FIGS. 11 and 12.

FIG. 13 is a bottom view of the fighting glove 10 shown in FIGS. 11 and 12 with the stability or support strap 20 wrapped around the wrist 42 of the fighter and closed over the attachment straps 30, 32. At this point, the fighting glove 10 is fully installed on the fighter. It should be noted that the hand 40 shown in these FIGS. is bare, but that typically hands of fighters 40 are wrapped before gloves 10 are installed prior to fights.

Those skilled in the art will recognize that modifications and variations can be made without departing from the spirit of the invention. Therefore, it is intended that this invention encompass all such variations and modifications as fall within the scope of the appended claims.

What is claimed is:

1. A fighting glove for a fighter, the fighter having a wrist and a hand including a palm and a thumb and a plurality of fingers, said glove comprising:

a back hand cover including a top and a bottom spaced apart from one another by a pair of sides extending between said top and said bottom for covering a back of the hand of the fighter, a front hand cover including an upper portion and a lower portion spaced apart from one another by a pair of edges between said upper portion and said lower portion with said edges connected to said sides of said back hand cover to define an interior between said covers for receiving the hand of the fighter, said front hand cover defining an aperture between and spaced from said edges of said front hand cover and extending toward said upper portion of said front hand cover and spaced from said upper portion for exposing the palm and the thumb of the fighter when the hand of the fighter is disposed in said interior of said fighting glove in an installed condition, a first plurality of fasteners, a second plurality of fasteners, a third plurality of fasteners, and a fourth plurality of fasteners, said lower portion of said front hand cover and said bottom of said back hand cover defining an inner attachment strap comprising said first plurality of fasteners, an outer attachment strap extending from one of said edges of said front hand cover to a coupling end and defining an outer surface extending from said one of said edges of said front hand cover to said coupling end for covering at least a portion of said inner attachment strap adjacent to said lower portion of said front hand cover, said outer attachment strap including an inner surface comprising said third plurality of fasteners extending between said one of said edges of said front hand cover and said coupling end for locking said third plurality of fasteners with said first plurality of fasteners on said inner attachment strap in the installed condition, a support strap extending outwardly from said back hand cover and adjacent to said one of said edges of said front hand cover for wrapping around said lower portion of said front hand cover and said bottom of said back hand cover and in overlapping relationship with said attachment straps to wrap around the wrist of the fighter and to secure said front hand cover and said back hand cover to the wrist of the fighter in the installed condition, said support strap defining an inside surface comprising said fourth plurality of fasteners for covering said attachment straps in the installed condition, and characterized by said inside surface of said support strap comprising a smooth portion extending from said back hand cover in a parallel relationship and coextensive with said fourth plurality of fasteners and said smooth portion defining a surface area equal to said outer surface of said outer attachment strap for covering and freedom from attachment to said outer surface of said outer attachment strap in the installed condition, said support strap defining an exterior surface opposite and parallel to said inside surface and comprising said second plurality of fasteners adjacent said one of said pair of edges of said front hand cover for receiving said fourth plurality of fasteners of said inside surface of said support strap when said support strap is wrapped around the wrist of the fighter and in overlapping relationship with said second plurality of fasteners in the installed condition, a plurality of finger sleeves disposed next to one another along said upper portion of said front hand cover and said top of said back hand cover for surrounding the fingers of the fighter and each of said finger sleeves jointly formed and defined by said top of said back hand cover and said upper portion of said front hand cover and extending outwardly from said covers to a distal end.

2. A fighting glove as set forth in claim 1 wherein said inner surface of said outer attachment strap has a first surface area of said third plurality of fasteners and said inner attachment strap has a second surface area of said first plurality of fasteners and said first surface area and said third plurality of fasteners extending between said one of said pair of edges of said front hand cover and said coupling end for engaging a portion of said first plurality of fasteners of said inner attachment strap adjacent to said lower portion of said front hand cover.

3. A fighting glove as set forth in claim 1 further including a padding disposed in said interior and attached to said back hand cover and said finger sleeves and extending from said distal end of said finger sleeves to said bottom of said backhand cover for covering a back of the hand and knuckles of the fighter.

4. A fighting glove as set forth in claim 3 further including a lining of absorbent material disposed in said interior and covering said padding and attached to said back hand cover and said front hand cover extending from said bottom of said back hand cover and said lower portion of said front hand cover to said distal ends of said finger sleeves for wicking away perspiration from the fighter.

5. A fighting glove for a fighter, the fighter having a wrist and a hand including a palm and a thumb and a plurality of fingers, said glove comprising:

a back hand cover of soft leather material including a top and a bottom disposed in a parallel relationship with one another and spaced apart from one another by a pair of sides extending in a perpendicular relationship with and between said top and said bottom to define a rectangular shape for covering a back of the hand of the fighter, a front hand cover of soft leather material including an upper portion and a lower portion disposed in a parallel relationship with one another and spaced apart from one another by a pair of edges in a perpendicular relationship with and between said upper portion and said lower portion, said edges of said front hand cover connected to said sides of said back hand cover to define an interior between said covers for receiving the hand of the fighter, a plurality of finger sleeves each of soft leather material and having a tubular shape disposed next to one another along said upper portion of said front hand cover and said top of said back hand cover and each of said finger sleeves jointly formed and defined by said top of said back hand cover and said upper portion of said front hand cover and extending outwardly from said covers to a distal end for surrounding the fingers of the fighter, a padding disposed in said interior and attached to said back hand cover and said finger sleeves and extending from said distal ends of said finger sleeves to said back hand cover for covering a back of the hand and knuckles of the fighter, a lining of absorbent material disposed in said interior and covering said padding and attached to said back hand cover and said front hand cover extending from said bottom of said back hand cover and said lower portion of said front hand cover to said distal ends of said finger sleeves for wicking away perspiration from the fighter, said front hand cover defining an aperture disposed between and spaced from said edges of said front hand cover and extending toward said upper portion of said front hand cover and spaced from said finger sleeves and said upper portion of said front hand cover for exposing the palm and the thumb of the fighter when the hand of the fighter is disposed in said interior of said fighting glove in an installed condition, a first plurality of fasteners, a second plurality of fasteners, a third plurality of fasteners, and a fourth plurality of fasteners, said lower portion of said front hand cover and said bottom of said back hand cover defining an inner attachment strap comprising said first plurality of fasteners, an outer attachment strap of rectangular shape extending from one of said edges of said front hand cover in a parallel relationship with said lower portion of said front hand cover to a coupling end and defining an outer surface extending from said one of said edges of said front hand cover to said coupling end for covering at least a portion of said inner attachment strap adjacent to said lower portion of said front hand cover, said outer attachment strap including an inner surface comprising said third plurality of fasteners extending between said one of said edges of said front hand cover and said coupling end for locking said third plurality of fasteners with said first plurality of fasteners on said inner attachment strap in the installed condition, a support strap of rectangular shape extending outwardly from said back hand cover and adjacent to said one of said edges of said front hand cover for wrapping around said lower portion of said front hand cover and said bottom of said back hand cover and in overlapping relationship with said attachment straps to wrap around the wrist of the fighter and to secure said front hand cover and said back hand cover to the wrist of the fighter in the installed condition, said support strap defining an inside surface comprising said fourth plurality of fasteners for covering said attachment straps in the installed condition, said support strap defining an exterior surface opposite and parallel to said inside surface and comprising said second plurality of fasteners adjacent said one of said pair of edges of said front hand cover for receiving said fourth plurality of fasteners of said inside surface of said support strap when said support strap is wrapped around the wrist of the fighter and in overlapping relationship with said second plurality of fasteners in the installed condition, and characterized by, said inner surface of said outer attachment strap has a first surface area of said third plurality of fasteners and said inner attachment strap has a second surface area of said first plurality of fasteners and said first surface area and said third plurality of fasteners extending between said one of said edges of said front hand cover and said coupling end for engaging said first plurality of fasteners of said inner attachment strap adjacent to said lower portion of said front hand cover, said inside surface of said support strap comprising a smooth portion extending from said back hand cover in a parallel relationship and coextensive with said fourth plurality of fasteners and said smooth portion defining a surface area being equal to said outer attachment strap for covering and freedom from attachment to said outer surface of said outer attachment strap in the installed condition.

* * * * *